United States Patent [19]

Ballester

[11] Patent Number: 4,640,322

[45] Date of Patent: Feb. 3, 1987

[54] METHOD AND APPARATUS FOR FILLING A RECEPTACLE WITH A MATERIAL

[75] Inventor: Edwin Ballester, Babylon, N.Y.

[73] Assignee: Cozzoli Machine Co., Plainfield, N.J.

[21] Appl. No.: 814,314

[22] Filed: Dec. 30, 1985

Related U.S. Application Data

[63] Continuation-in-part of Ser. No. 746,363, Jun. 19, 1985, abandoned, which is a continuation of Ser. No. 537,266, Sep. 29, 1983, abandoned.

[51] Int. Cl.[4] ..... B65B 1/38; B65B 3/14

[52] U.S. Cl. ..... 141/5; 141/67; 141/84; 141/129; 141/286; 141/367; 222/309; 222/630; 417/149; 251/7

[58] Field of Search ..... 141/84, 1–12, 141/37–70, 129–191, 198, 285–310, 250–284, 367, 368; 92/60.5; 417/149, 900; 222/309, 630; 422/100; 251/4–10

[56] References Cited

U.S. PATENT DOCUMENTS 1,359,367 11/1920 Hansen ..... 141/84

2,778,387 1/1957 Diehl ..... 141/84

4,212,331 7/1980 Benatar ..... 141/67

*Primary Examiner*—Houston S. Bell, Jr.

*Attorney, Agent, or Firm*—Kirschstein, Kirschstein, Ottinger & Israel

[57] ABSTRACT

A machine for applying sub-atmospheric pressure through a filter to pull material from a hopper laterally into a non-rotatable chamber at a presettable volume and after the chamber is filled blowing the material out of the chamber through the filter out of a discharge nozzle at the bottom of the chamber into a receptacle. In a preferred embodiment, the material is a pulverulent material which is fluent en masse and the material is aspirated into the measuring chamber by applying a sub-atmospheric pressure above a variably positionable head in the chamber which head has a filter in it through which the suction is drawn. After the chamber is filled, a super-atmospheric pressure is applied over the head to shoot the mass of particulate material out of the discharge nozzle, the particulate material having been held back by a discharge valve prior to the application of the super-atmospheric pressure.

20 Claims, 15 Drawing Figures

STAND BY
VACUUM
PRESSURE
3 WAY VALVE
96
100
106
102
98
104
35
88
17
90
67b
67a
34
92
86
94
80
44
30
20
28
42
83
84
82
110
109
36
112
114
108
118
VACUUM
116
18
12

FILLING
VACUUM
PRESSURE
3 WAY VALVE
VACUUM
35
96
100
106
104
102
98
88
17
90
67b
67a
34
92
86
80
94
44
30
20
83
28
42
84
82
110
109
36
114
112
108
118
116
18
12

DOSING
VACUUM
PRESSURE
3-WAY VALVE
96
100
106
104
102
98
35
88
17
90
67b
67a
34
86
92
94
80
44
30
20
83
28
42
84
82
110
109
108
36
112
114
118
VACUUM
116
18
12

PURGING
VACUUM
PRESSURE
3 WAY VALVE
96
100
106
104
102
98
35
88
17
90
67b
67a
34
92
86
94
80
44
30
20
83
28
42
84
82
110
109
36
114
112
108
118
VACUUM
116
18
12

METHOD AND APPARATUS FOR FILLING A RECEPTACLE WITH A MATERIAL

CROSS REFERENCE TO RELATED APPLICATIONS

This application is a continuation-in-part of co-pending application Ser. No. 746,363, filed June 19, 1985 for "An Apparatus for Automatically Filling a Product Into a Receptical" (now abandoned) which is a continuation of application Ser. No. 537,266, filed Sept. 29, 1983 for "An Apparatus for Automatically Filling a Product Into a Receptical" (now abandoned).

BACKGROUND OF THE INVENTION

1. Field of the Invention

This invention principally relates to a machine for applying subatmospheric pressure through a filter to suck particulate material, fluent en masse, from a hopper laterally into a non-rotatable measuring chamber of presettable volume and, after the chamber is filled, applying super-atmospheric pressure through the filter to force the particulate material downwardly out of the chamber through a nozzle into a receptacle. Optionally, a discharging pressurized pulse is followed by a brief more highly pressurized pulse to purge the filter. An ancillary feature of the invention is concerned with ready interchangeability of the machine from the dispensing of liquid to that of particulate material and vice versa.

2. Description of Related Art

Equipment for filling receptacles with liquid and with flowable dry particulate material is quite old in the art and has been available for many years. Nevertheless, in many fields they are susceptible to improvements. Thus, in the pharmaceutical field, where such machines are widely used, it is particularly desirable for the parts of the machines, which contact pharmaceutical materials that are to be packaged, to be as few in number and as small in size as possible and to be readily accessible for cleaning and sterilization, and refinements are constantly being designed to this end. Furthermore, and especially in pharmaceutical filling machines, it is quite advantageous for the machines to maintain a high degree of accuracy. The same aspiration exists in non-pharmaceutical fields and, there too, the quest as yet has not been satisfied.

Typical prior art filling machines are manufactured by PERRY INDUSTRIES, INC. of Hicksville, N.Y., being known as PERRY ACCOFILS, a registered mark, these being the series 0, 1, and 2, Models CMR 124; and CMR 2. These machines are continuous motion rotary powder fillers, purported to be designed for high-speed, fully automatic, powder filling. They include a hopper which leads to a rotary filling wheel that turns about a horizontal axis continuously through successive 360° cycles. The wheel includes plural cylinders, known as ports, each terminating at an open mouth on the periphery of the wheel. Each port includes an internal filter-containing head. The heads can be set in any desired axial positions within the ports to define between each head and the periphery of the wheel a chamber of settable volume. As the wheel rotates, the cavities of the ports are subjected one after another, sequentially, to sub-atmospheric and supra-atmospheric pressure. When a port is erect, with its mouth uppermost, its mouth is exposed to the hopper. At the same time, suction is applied beneath the filter-head and thence to this port to draw the product, which is powder, from the hopper into the port. As the wheel rotates, this port leaves the hopper and passes beneath a doctor blade which brushes excess product off the top of the port while vacuum is maintained on the filled port. Continued rotation of the wheel brings the port to a downwardly extending position over a transition funnel that leads to a container for the powder. At the transition funnel, a puff of pressurized air is applied above the back of the filter-head and thence to the powder in the measuring chamber to eject the powder from the port into the funnel and thereupon into the container. Upon further rotation of the wheel, a more highly pressurized pulse of purge air is applied to the back of the filter-head to clean the filter. Finally, the port returns to its erect position for a refill from the hopper.

The cooperation of the port as it enters into and leaves alignment with the hopper discharge opening produces a valve-like action which, on the one hand, permits and, on the other hand, cuts off flow of powder from the hopper to the port. The same type of action is experienced between the port and the transition funnel upon discharge of powder from the port. In both instances, a pair of relatively moving parts move past one another in shear to cut off flow of powder and in doing so subject the last particles of powder flowing through the valve to a shearing action between two relatively moving surfaces. This shearing action further reduces the size of the particles caught which has certain deleterious effects. These fragmented particles find their way into the interstices of the machine where they interfere with relative movement of machine parts; increase the power requirements of the machine; increase the wear to which the machine is subjected; and, to some extent, become mixed in with the powder which the machine is handling which may adversely affect the reaction created by the powder if used pharmeceutically on a patient, as by unduly increasing the speed of reaction to an unpredictable extent. A further disadvantageous effect is that the fragmented particles roll between the opposing surfaces which are passing one another in shear and scrape off tiny detritus from these surfaces which mix in with the powder to contaminate the same.

The containers are fed in line to a star wheel that transfers them to a rotary dial plate which passes the containers, each under a transition funnel, to a filling station where they are lifted into coupling relationship to a discharge outlet with an associated transition funnel and are filled. Finally, the filled containers are closed and transferred to an exit line. All of the filter-heads can be adjusted simultaneously in their ports. Other types of line filling equipment also have been employed in these machines.

The machine is capable of filling up to 300 containers per minute with from 50 mg. to 36 ozs. of product. There are a relatively large number of parts and the machine is, therefore, costly to maintain and keep in good working condition. Many of the parts that touch the powder, are exposed, making the machine difficult to keep clean and, for pharmaceutical products, difficult to sterilize. The machine allows the product to escape at various points, with resultant loss of product which is uneconomical and unsanitary and creates a bad working environment. Because of the multiple adjustments of the several ports, such adjustments, although interlocked, are not easy to make.

Another problem with the Perry machine is that the agitator is a rotary member which is driven by a shaft that extends through the side of the hopper in a bearing. As the shaft turns, the bearing wears and in so doing discharges a thin, but steady flow of particulate material worn from the seal. This material is permitted to flow into the powder being handled by the machine where it may contaminate the same.

It would be a considerable boon to the industry if a filling machine were provided that was of far simpler and less costly construction.

PERRY INDUSTRIES, INC. also manufactures a line of equipment designed to fill only liquids into containers. These are separate machines which cannot be converted to switch from powder to liquid and vice versa; while these liquid fillers may be suitable for the particular purposes to which they are addressed, they are not suitable for the purposes of the present invention as hereinafter described.

SUMMARY OF THE INVENTION

1. Purposes of the Invention

It is a principal object of the present invention to provide a simple, high-speed, low-cost machine capable of rapidly filling containers with flowable particulate material, such as powder and the like, which machine is rugged in construction and is capable of running for long periods of time with low maintenance and yet is quickly and readily adjustable to different types of particulate material and different volumes of material to be dispensed.

It is another object of the invention to provide a machine of the character described which, despite the fact that it operates on particulate material which generally is quite dry, does not throw off a great deal of dust or dirt and, when necessary, is readily taken apart for cleaning and sanitizing.

It is another object of the invention to provide a machine of the character described which can be operated by relatively unskilled help and is almost trouble-free.

It is another object of the invention to provide a machine of the character described which purges itself after every filling operation.

It is another object of the invention to provide a machine of the character described which utilizes an agitator so constructed and arranged that it does not contaminate the product handled by the machine.

It is another object of the invention to provide a machine of the character described which can dispense powder and which employs a cut-off valve of the pinch type to control the discharge of powder so that it is not subject to the sundry drawbacks of the shear-type discharge valve of the Perry machine or the like.

It is another object of the invention to provide a machine of the character described which will dispense powder and which does not employ an inlet valve between the hopper and the measuring chamber and thus does away with the difficulty created by the use of a shear-type valve employed by the Perry machine and the like at this point.

It is an ancillary object of the invention to provide a machine of the character described which can handle either a powder or a liquid.

It is another ancillary object of the invention to provide a machine of the character described which, by changing a few parts, enables the machine to be switched from a powder to a liquid and back again.

Other objects of the invention in part will be obvious and in part will be pointed out hereinafter. The invention accordingly consists of combinations of elements, arrangements of parts and features of construction which will be illustrated in the drawings and some of which will be set forth in the appended claims.

2. Brief Description of the Invention

As indicated previously, the machine has two aspects or, two embodiments. As the principal embodiment, the machine is designed solely to handle powder, i.e. particulate material. In this embodiment the machine constitutes a hopper into which the particulate material is introduced. The hopper has an exit port, usually a gravity exit port. The machine also includes a measuring chamber near the hopper and usually at a lower level than the hopper so that a gravity feed can be used to convey the particulate material from the hopper to the measuring chamber. The measuring chamber has an input port near its bottom which input port is connected to the exit port of the hopper. The particulate material flows from the hopper to the measuring chamber, under gravity, with assistance to be provided as shortly described. Furthermore, the machine includes an infeed valve located between the exit port of the hopper and the input port of the measuring chamber. This valve can either be opened or closed by any suitable mechanism. This very component of the machine, i.e. the foregoing infeed valve, can be omitted and, indeed, in the preferred form of the invention to be described, said valve is not present, it having been found that the machine operates satisfactorily without the valve for reasons which will be discussed subsequently, and, indeed, the omission of this valve is preferred.

Within the measuring chamber, and upstream of the infeed valve, that is to say, within the cavity of the measuring chamber and remote from the base thereof, there is a variably positionable head. The head has a filter associated with it and the head also has associated with it, a means that provides a passageway through it. The passageway is blocked by a filter, blocked as used in a physical sense, in other words, the filter lies across the passageway, but it does not block it to the extent that it prevents all flow of medium through the filter, it just prevents flow of anything through the filter that the filter does not permit to go through it. At the bottom of the measuring chamber, the machine is provided with a discharge nozzle upstream of which the machine is provided with a discharge valve. Associated with the machine there is a suitable mechanism to supply a vacuum pressure and to provide gas such as air at above atmospheric pressure. The machine has a means for controlling the infeed valve and the discharge valve in a manner such that the infeed valve opens after the discharge valve is fully closed in each cycle. This allows the powder to enter the cavity of the measuring chamber from the hopper beneath the variably positionable head while, at the same time, vacuum pressure is applied under the variably positionable head through the passageway therein and through the filter to suck the powder into the measuring chamber from the hopper through the input port whereby to fill up the measuring chamber. Thereupon when the infeed valve fully closes and the discharge valve opens, air under pressure is admitted to pass through the passageway in the variably positionable head and through the filter into the measuring chamber to push the powder down from the measuring chamber into the receptacle through the discharge nozzle. At this point, the discharge valve closes and the infeed valve opens; subsequently, a purging pressure passes through the passageway in the variably positionable head and through the filter to clean out the measuring chamber and the filter and drive any residual powder back into the hopper. Thereupon the cycle repeats itself.

Throughout its operational cycle, the discharge nozzle alone or the discharge nozzle along with the measuring chamber, as the discharge nozzle and measuring chamber are connected to one another so as to be a kinematically integral unit, is (are) reciprocated into and out of the mouth of a container beneath the nozzle, or the container may be raised and lowered to permit the nozzle and the container to be coupled during the actual dosing as is conventional in the art. However, except for the possibility of such a slight vertical movement which, in any event, is very small, the measuring chamber is stationary or essentially so, so that the filling mechanism is quite compact and hence quite conservative of space in contrast to the comparatively cumbersome machines of PERRY INDUSTRIES, INC.

The novel features which are considered as characteristic of the invention are set forth in particular in the appended claims. The invention itself, however, both as to its construction and its method operation, together with additional objects and advantages thereof, best will be understood from the following description of specific embodiments when read in connection with the accompanying drawings.

DETAILED DESCRIPTION OF THE PREFERRED EMBODIMENTS

Figure 1:
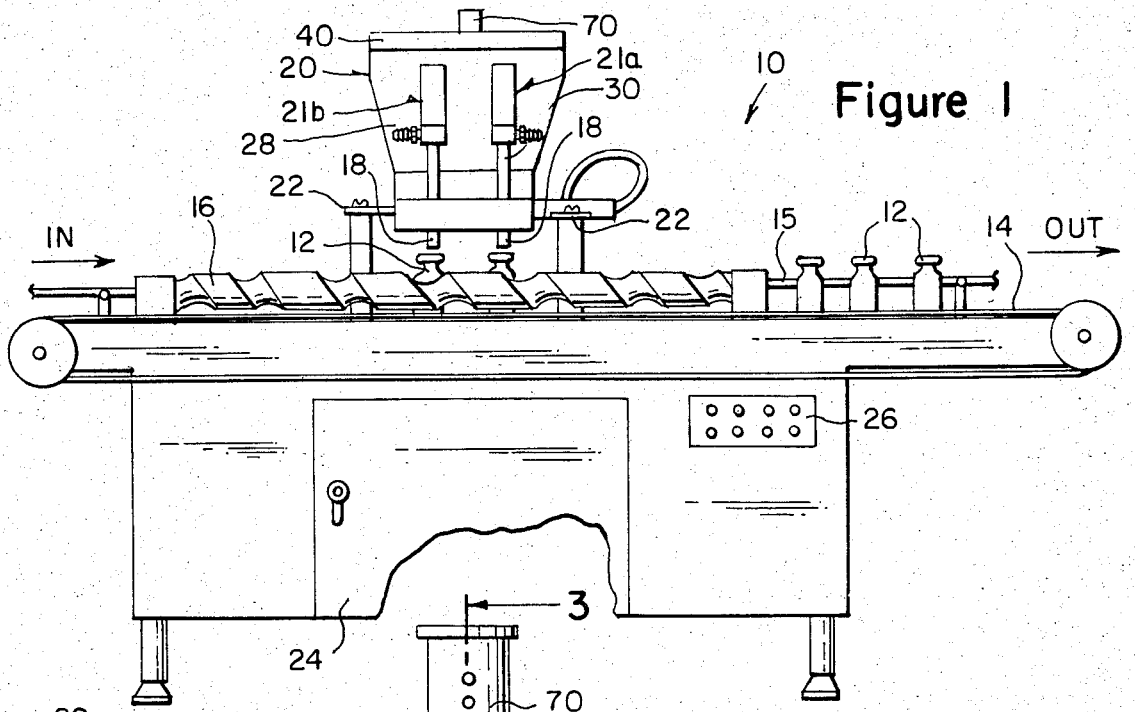
FIG. 1 is a front view of a machine embodying the invention which will handle either liquid or powder.
Figure 2:
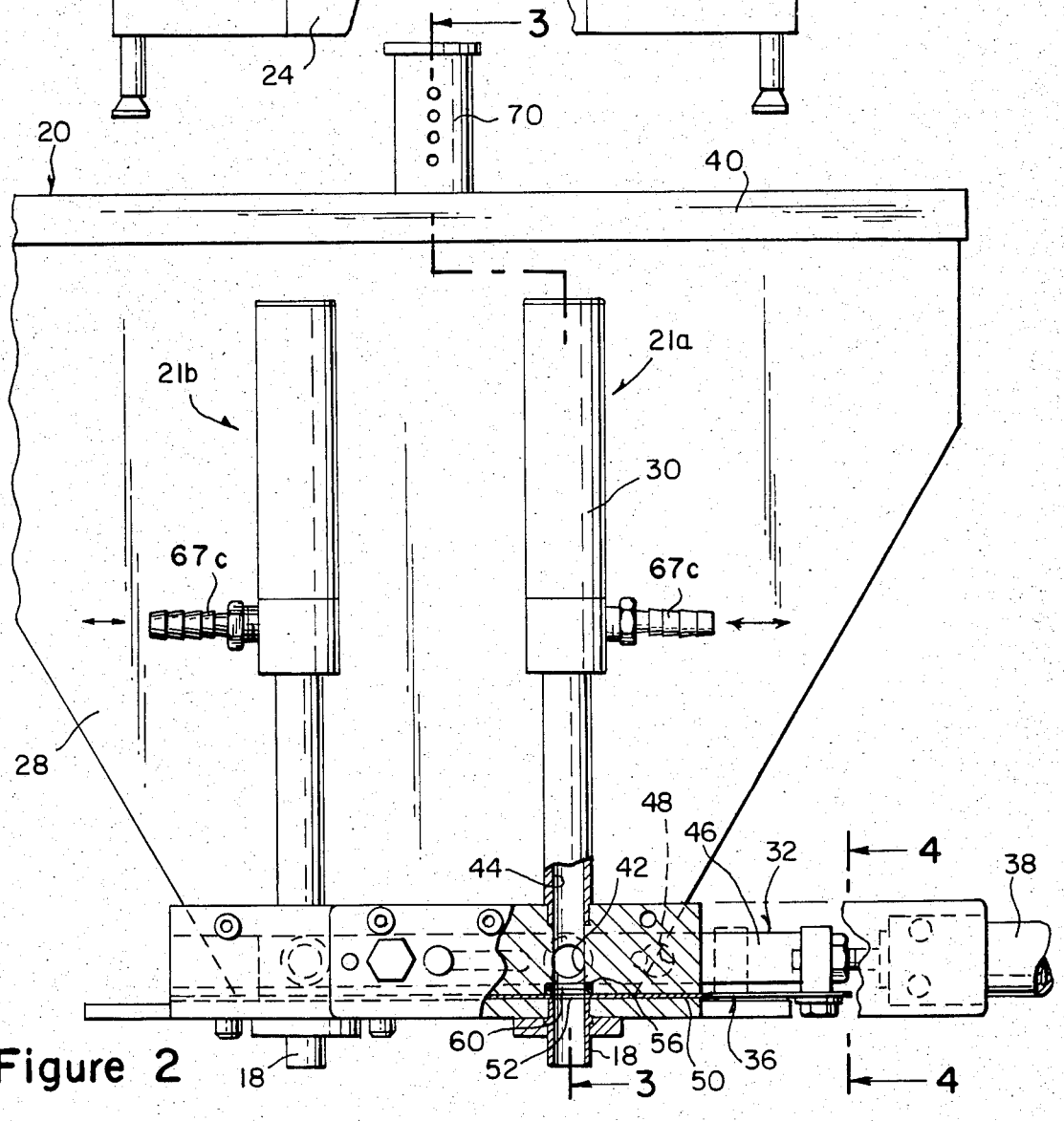
FIG. 2 is an enlarged front view partly in section of said machine.
Figure 3:
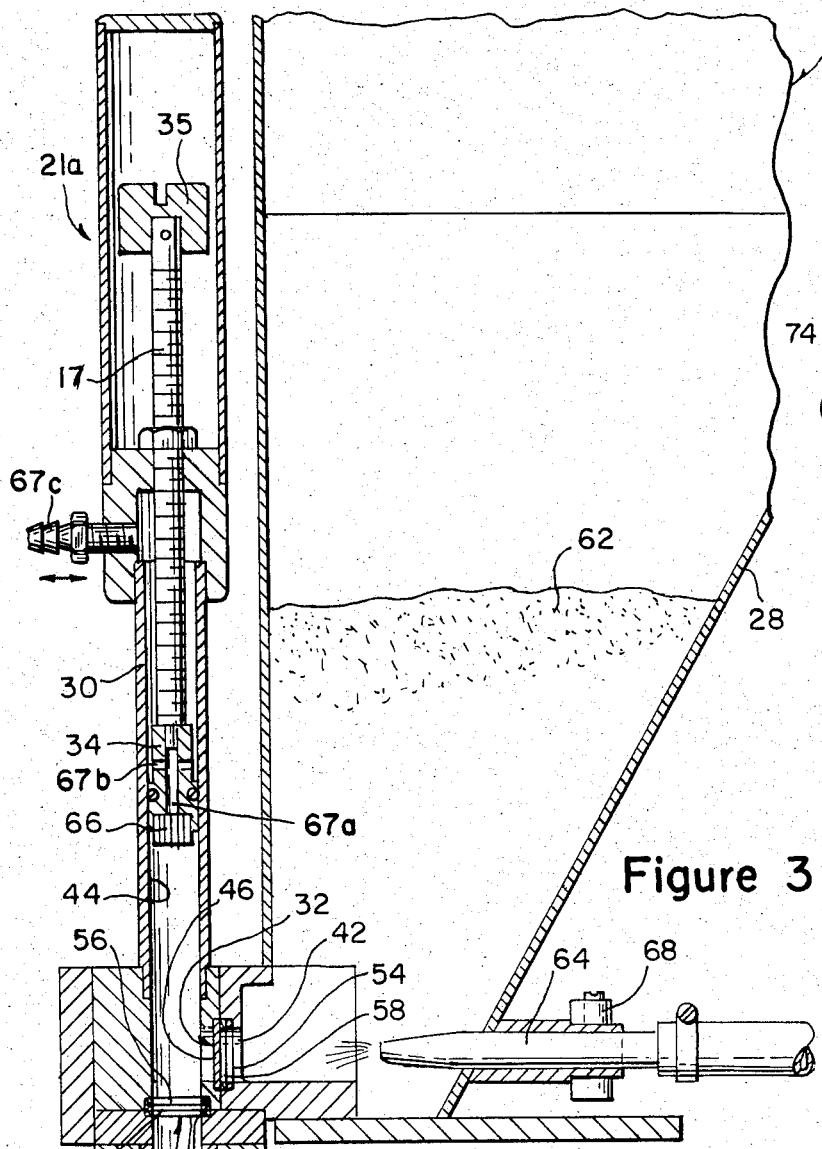
FIG. 3 is an enlarged cross-sectional view taken substantially along the line 3—3 of FIG. 2.
Figure 10A:
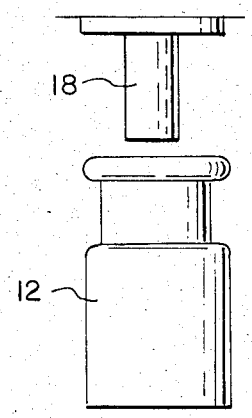
FIG. 10*a* is a partial elevational view of the discharge nozzle in a raised position in relationship to a receptacle.
Figure 10B:
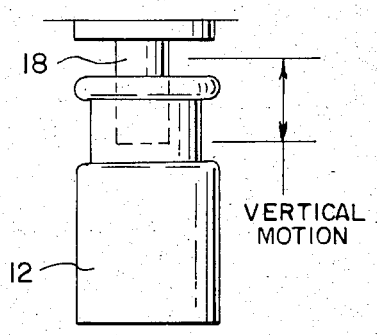
FIG. 10*b* is a view similar to FIG. 10*a* of the discharge nozzle in its down position.

Turning now to the drawings, in which similar reference characters denote similar elements throughout the several views, FIG. 1 illustrates an apparatus 10 for automatically filling a product into a receptacle 12. A series of receptacles 12, such as vials, containers, etc., are transported on a conveyor belt 14 with the aid of a guide rail 15 to an intermittent control device 16 such as a feed screw. A star wheel or fingers can also be used. The receptacles 12 are stopped either singularly or in multiples under one or more discharge nozzles 18 which dispense the product into the receptacles 12 one or more doses at a time. The discharge nozzles 18 are part of a dispensing head 20 that is affixed to the apparatus 10 by mounting brackets 22. The dispensing head 20 has a vertical movement for the purpose of inserting the discharge nozzles 18 into the receptacles 12 just before dosing (see FIGS. 10*a* and 10*b*). A control panel cabinet 24 and a push-button station 26 are also provided.

FIGS. 2 through 5 illustrate the dispensing head 20 in greater detail. The dispensing head 20 consists of a hopper 28, two vertical measuring chambers 30, two infeed valve orifices 32, two variably positionable heads 34, two discharge valve orifices 36 and one air cylinder 38 or activating means, e.g. a solenoid. In describing the dispensing head 20 only one feed system 21*a* is described. The other feed system 21*b* is exactly of the same structure. The product is fed into the hopper 28 when a top cover 40 is removed. The top cover 40 has an air pressure relief valve 70. The hopper 28 has a horizontal exit port 42 at its bottom. The vertical measuring chamber 30 has a cavity 44 transversely connected to the exit port 42 of the hopper 28. The infeed valve 32 is placed within the exit port 42 of the hopper. The variably positionable head 34 is placed above the infeed valve 32 within the cavity 44 of the measuring chamber 30. The discharge valve 36 is placed below the infeed valve 32 within the cavity 44 of the measuring chamber 30.

The air cylinder 38 simultaneously controls the infeed valve 32 and the discharge valve 36 so that the infeed valve 32 opens after the discharge valve 36 is fully closed allowing the product to enter the cavity 44 of the measuring chamber 30. When the infeed valve 32 fully closes the discharge valve 36 opens allowing superatmospheric air forced through the variably positionable head 34 to push the product down through the dispensing nozzle into the receptacle 12.

Figure 9:
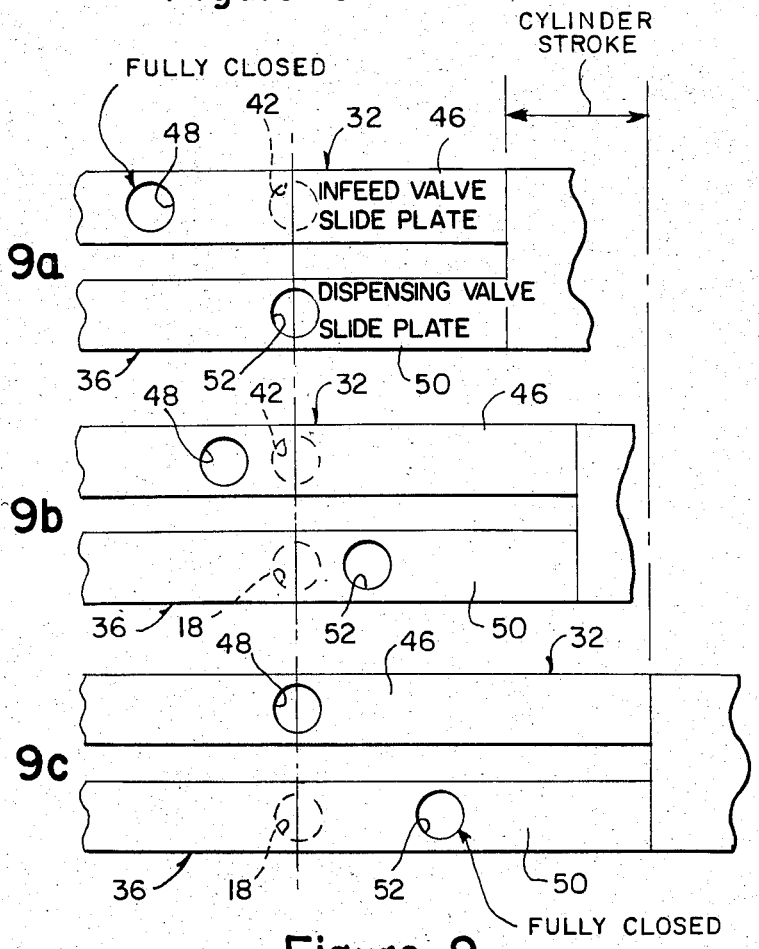
FIGS. 9*a*, 9*b* and 9*c* are diagrammatic plan views of the infeed valve and the discharge valve in various positions thereof showing how an offset, to be described in the specification, works.

The infeed valve 32 is a vertical slide plate 46 that has an infeed aperture 48 therethrough. The discharge valve 36 is a horizontal slide plate 50 that has a discharge aperture 52 therethrough offset from the infeed aperture 48 in the vertical slide plate 46. The offset is spaced so that both infeed and discharge apertures 48 and 52 are totally closed before either aperture is opened, see FIG. 9*b*. When the discharge valve 36 fully closes the infeed valve opens (see FIG. 9*c*) and when the infeed valve 32 fully closes the discharge valve 36 opens (see FIG. 9*a*). Either valve opens only after the other valve closes, that is first one valve closes then the other valve opens and vice versa.

The feed system 21*a* further contains a pair of O-rings 54,56 and a pair of valve washers 58,60. The first O-ring 54 is placed within the horizontal exit port 42 of the hopper 28 while the second O-ring 56 is placed within the cavity 44 of the vertical measuring chamber 30. The O-rings 54,56 prevent leakage of the product. The first valve washer 58 is placed within the horizontal exit port 42 of the hopper 28 between the first O-ring 54 and the vertical slide plate 46 of the infeed valve 32 while the second valve washer 60 is placed within the cavity 44 of the vertical measuring chamber 30 between the second O-ring 56 and the horizontal slide plate 50 of the discharge valve 36. The valve washers 58,60 prevent friction on the first and second O-rings 54,56.

If the product being used is a powder 62 a jet 64 (see FIG. 3) and a filter 66 will be used for the feed system 21*a*. The jet 64 is placed transversely within a bottom clamp 68 of the hopper 28 to apply a blast of air when the infeed valve 32 opens both to blow and suck powder 62 by entrainment into the cavity 44 of the measuring chamber 30. The filter 66 is placed across the bottom of the variably positionable head 34 to block the central and cross openings 67*a* and 67*b* and to permit the air under vacuum pressure within the cavity 44 of the measuring chamber 30 to pass through but not the powder 62 so as to further suck the powder 62 into the cavity 44 via said open infeed valve 32. Vacuum for this purpose is applied from a suitable source of sub-atmospheric pressure, e.g. a vacuum pump, to a hose connection 67*c* at the top of the cavity 44 at the same time the blast of air is applied by the jet 64. It will be noted that annular clearance is formed around the head 34 above the outer ends of the cross-passageways. After the side plates 46 and 50 shift, dosing as in the conventional manner, is accomplished when a blast of air or inert gas at super-atmospheric pressure is blown back through the filter 66 in the variably positionable head 34 to push out the powder 62 through the feed nozzle 18. A subsequent brief blast of air or an inert gas may follow for purging purposes. The control of vacuum or air or inert gas at super-atmospheric pressure is regulated in a conventional manner as by valves controlled electrically or pneumatically.

The jet 64 serves two purposes, one to fluidize the powder 62 in the hopper 28 with a low pressure flow of air or an inert gas, and secondly to apply a blast when the infeed valve 32 is opened to induce the powder 62 to enter into the cavity 44 of the measuring chamber 30.

An automatic timing control system of any number of manufacturers is used to time the sequence of operation of jet blast, suction pressure, valve opening and closing, etc.

A unique feature of this design is the use of the air jet 64 both to blow and induce the flow of the powder 62 into the empty cavity 44, while simultaneously sucking out the air from the cavity 44 using a vacuum pressure. Another feature is the use of the slide plates 46 and 50 operated by a single air cylinder 38. The construction of the slide plates 46 and 50, valve washers 58 and 60 to prevent friction on the O-rings 54 and 56, and the O-rings 54 and 56 to prevent leakage, are additional features in this patent application.

The variably positionable head 34 is presettable by an adjustable screw knob 35 mounted on an adjustment screw 17 to increase or decrease the size of the dose into the receptacle 12 as shown on the drawings. The apparatus 10 will also require an air or gas pump, a vacuum pump regulator, a pressure control and a vacuum control.

Figure 6:
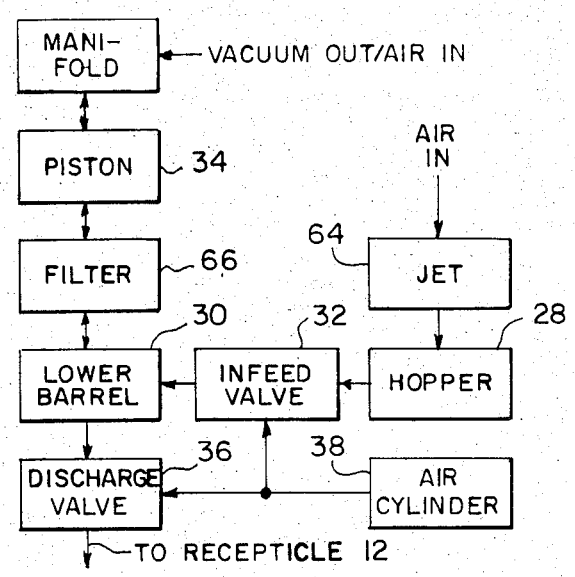
FIG. 6 is a flow chart of the system of the machine set up to handle particulate material.

FIG. 6 is a flow chart of the feed system 21*a* or 21*b* using powder 62. In the first phase of operation the infeed valve 32 is opened while the discharge valve 36 is closed by the air cylinder 38. The jet 64 applies a blast of air into the hopper 28 and through the infeed valve 32 to permit the powder 62 to enter the measuring chamber 30 while vacuum pressure is applied through the variably positionable head 34 and the filter 66 to suck the powder 62 into the measuring chamber 30. In the second phase of operation the infeed valve 32 is closed while the discharge valve 36 is opened by the air cylinder 38. The blast of air from jet 64 is reduced to low pressure to continue fluidizing the powder 62 in the hopper 28. The vacuum pressure is cut off and air pressure is applied through the variably positionable head 34 and filter 66 to the measuring chamber 30. The powder 62 in the measuring chamber 30 is then expelled through the discharge valve 36 into the receptacle 12. In the third phase of operation a new receptacle 12 is set up in the conventional manner for repeat of the first phase and second phase of operation.

Figure 7:
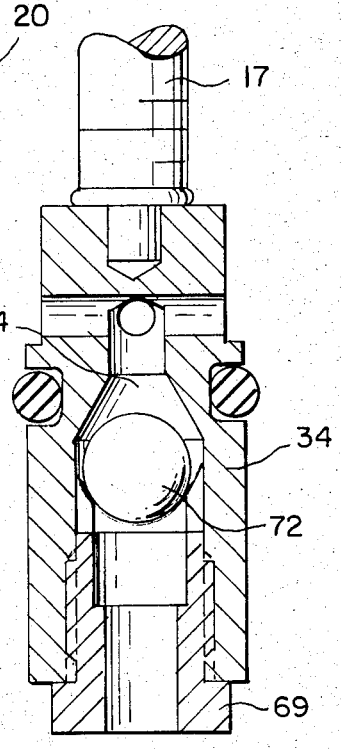
FIG. 7 is an enlarged cross-sectional view of a part of a piston used in the machine set up to handle liquid.
Figure 4:
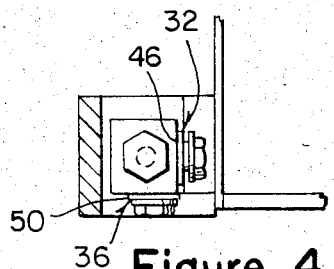
FIG. 4 is an enlarged cross-sectional view taken substantially along the line 4—4 of FIG. 2.
Figure 5:
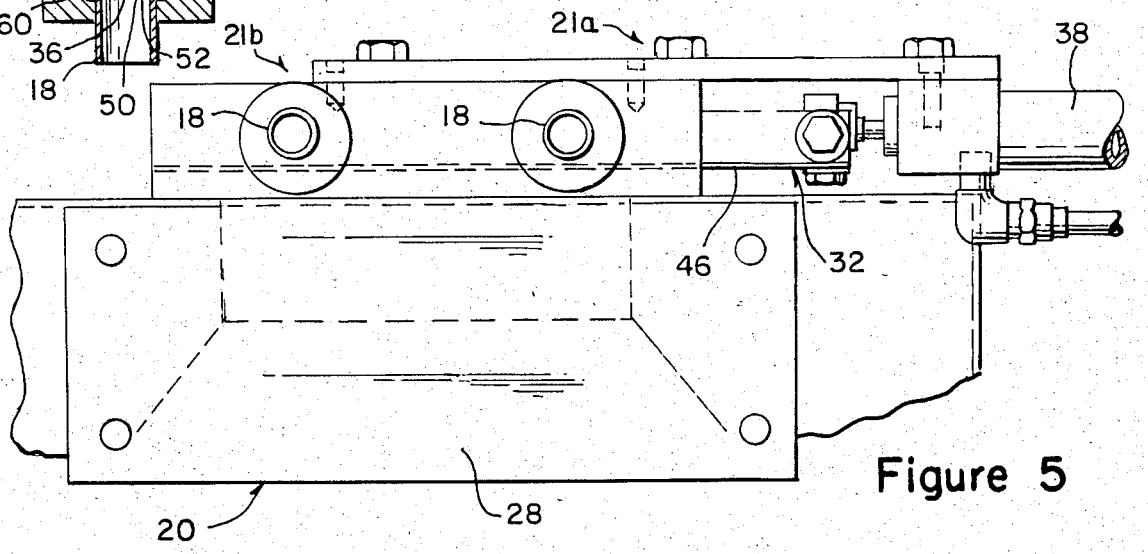
FIG. 5 is a bottom view of the machine as shown in FIG. 2.

If the product being used is a liquid, the liquid will enter the cavity 44 of the measuring chamber 30 by the flow of gravity. The hopper 28 could also be pressurized to permit the flow of liquid into the cavity 44. The gas jet 64 at the bottom will not be required. The piston 34 will be equipped with a ball check valve 69 (see FIG. 7) which will be open to permit any air bubble to be evacuated. When the product (liquid) reaches ball 72 it will close check valve orifice 74 to prevent the liquid from passing through the valve 69 into the upper portion of cavity 44. When the cavity 44 under the piston 34 is filled with liquid, the valves 32 and 36 will be shifted to the discharge mode and simultaneously a flow of air will pass through the check valve 69 and blow the liquid into the receptacle 12.

Figure 8:
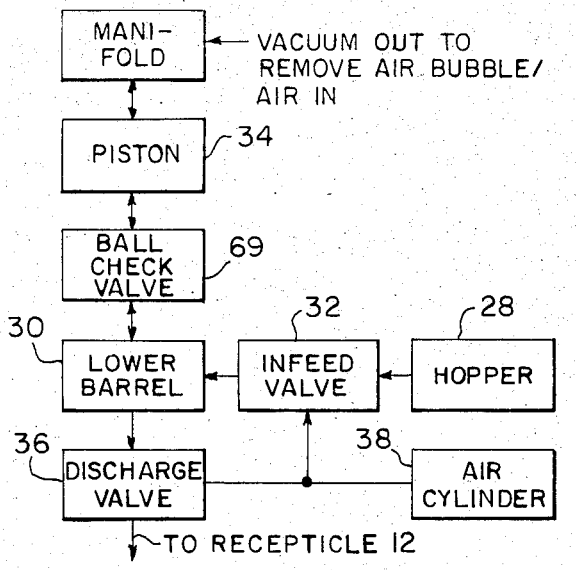
FIG. 8 is a flow chart of the machine set up to handle liquid.

FIG. 8 is a block diagram of the feed system 21*a* or 21*b* using liquid. In the first phase of operation the infeed valve 32 is opened while the discharge valve 36 is closed by the cylinder 38. The liquid will enter the measuring chamber 30 from the hopper 28. In the second phase of operation the infeed valve 32 is closed while the discharge valve 36 is opened by the air cylinder 38. Air pressure is then turned on through the variably positionable head 34 and ball check valve 69. The liquid in the measuring chamber 30 is then expelled through the discharge valve 36 into the receptacle 12. In the third phase of operation a new receptacle 12 is set up in the conventional manner for repeat of the first phase and second phase of operation.

In FIGS. 1 through 10 there have been shown and described two variations of what is essentially a single filling machine, namely a machine that is characterized by its ability to be converted readily from dispensing liquids to one for dispensing flowable pulverulent material and vice versa.

The market for such machines appears to be quite limited. There currently are available many types and brands of liquid filling machines that operate efficiently and economically, at high speeds and low costs, and are quite flexible in their parameters so that for the liquid filling aspect, the foregoing machine does not have a sufficiently appealing view point to be commercially desirable nor does the market seem to have a place for a liquid/powder filling machine, but there appears not to be commercially available any compact, high-speed, easily-maintained, reliable powder filling machine. It is believed that the state-of-the-art in powder filling machines is represented by those made by PERRY INDUSTRIES, INC. heretofore mentioned and it is to an improvement over such powder filling machines that the preferred embodiment of the present invention now to be described is directed. This embodiment is largely similar to the powder filling convertible variant of the machine earlier described, but is simpler in its operation and more compact in its structure. Such a machine is shown in and described with respect to FIGS. 11 through 14.

In these Figures the machine is denoted by the reference numeral 80. It includes a conveyor belt, a guide rail and an intermittent feed device such as described heretofore with respect to the apparatus 10, but its description is not here repeated. A series of receptacles 12, such as vials, or containers, are transported on said conveyor belt at spaced intervals and are intermittently stopped beneath the discharge nozzles 18 of a dispensing head (dispensing heads may be provided in multiples for filling of plural receptacles at a time. Since all the dispensing heads are identical, only one will be described in detail).

The dispensing head(s) 20 is supplied with a fluent pulverulent material such as powder from a hopper 28. Typical of powders that can be handled by the machine 80 are salt, pepper, sugar, flour, talc, pharmaceutical powders and salts, spices, ground coffee, freeze dried coffee, dried parsley and onion flakes, and bread crumbs all of which constitute particles small enough and light enough to be aspirated by a mild degree of suction in the order of about 24 inches of mercury. The hopper is supported on a stationary bracket 82 on its inclined bottom wall. Because powder has a tendency to bridge when withdrawn from a lower section of a large volume, an agitator 83 is provided which is reciprocated by a means (not shown) in a direction perpendicular to the plane of the drawings. The agitator is supported by a gooseneck arm which reaches out over the top edge of the open mouth of the hopper from a reciprocating member (not shown) so that the agitator support does not touch the hopper and thus cause contamination of any powder in the hopper.

The exit port 42 of the hopper is connected to the dispensing head(s) by a flexible, e.g. elastomeric, tube 84 to permit the dispensing head to shift vertically in order for the discharge nozzle 18 to move into coupling relationship with a vial 12 during a dosing operation and to move out of such relationship after dosing has been completed.

The dispensing head 20 includes a measuring chamber 30 which preferably is vertical. A deviation from the vertical is permissible, but not desirable.

A variably positionable head 34 is slidably, sealingly shiftable longitudinally of the axis of the elongated measuring chamber 30. Preferably, some simple arrangement, such as an O-ring 86 received in an annular groove in the periphery of the head 34, effects a desired sliding seal with the cavity 44 of the measuring chamber 30. A male threaded adjustment screw 17 having an adjustment screw cap 35 at its head engages a tapped bore 88 in a cap 90 mounted on top of the measuring chamber 30 to permit an adjustment of the head 34 lengthwise of the measuring chamber and thereby increases or decreases the volume of pulverulent material to be aspirated into the measuring chamber 30 so as to fill the same and subsequently be propelled into a vial beneath the discharge nozzle. The lower end of the adjusting screw is secured to the head 34. It may be rigidly secured thereto or it may be secured thereto so as to permit relative rotation of the head and screw, but not relative axial movement thereof in the direction of the longitudinal axis of the measuring chamber, whereby a turning of the adjustment screw varies the position of the head axially within the measuring chamber.

The interior dimensions and configuration of the section of the measuring chamber within the range of movement of the measuring chamber that can be brought about by the turning of the adjustment screw uniformly nicely, negatively matches the external cross-sectional configuration and dimensions of the head to bring about the aforesaid desired sliding sealing fit aided by the O-ring 86.

Communication is provided between portions of the cavity 44 above and below the head by provision of a central passageway **67*a* leading from the bottom surface of the head 34 upwardly to a level above the O-ring 86 and terminating in lateral outwardly extending cross-passageway 67*b* which lead to the sides, i.e. to the side walls of the head, thus providing access to an annular space within the cavity 44 around the adjustment screw and below the cap 90. The bottom of the head 34 is formed with a well 92 which is bridged by a filter 94, the purpose of which is to permit the passage therethrough of a gas such, for example, as air or an inert gas, e.g. nitrogen, but to prevent the throughflow of the particulate material being handled by the dispensing head 20**. It will be quite apparent that a wide variety of filters can be employed dependent upon the particular material to be dispensed, which, as indicated earlier, can be quite broad in range, examples of which have been set forth previously, the sizes of which traverse an enormous spectrum. Thus, the filter can be a mesh filter, or a molded filter made for instance of metal or plastic; it can be wooden or felted or made of glass fibers or paper; it can be sintered and made of metal, powder or compressed carbon. The pore sizes or sizes of available openings, must be small enough to block the passage of the particulate material being handled, but large enough to permit passage of gas through it under a mild degree of pressure such as mentioned hereinafter and not itself to be blocked by the particles. By way of example and considering a particle size of from about 0.5 μm to about 1 micron, the size for the filter openings for the filter is selected to be slightly smaller than the largest dimension of the particle size for particles being handled, e.g. a 3 μm filter for 5 μm particles. The filter is quite thin, usually just from about three to about seven thousandths of an inch thick and is held in place by any suitable means as, for example, a peripheral adhesive layer. Its thickness is exaggerated in the drawings for the sake of illustration. It is readily strippable and replaceable. When plastic, metal or glass filters are employed, they can be flushed with liquid and reused after drying.

The apparatus 80 includes a source 96 of sub-atmospheric pressure and a source 98 of super-atmospheric pressure. Although the precise degree of pressure will depend upon the material being handled, typically, for a pharmaceutical material, such as mentioned earlier, the source of sub-atmospheric pressure will provide a sub-atmospheric pressure in the order of about 24 inches of mercury and a source of super-atmospheric pressure will provide an air atmospheric pressure or an inert gas atmospheric pressure, e.g. a nitrogen atmospheric pressure in the order of 2 to about 10 psig. These two pressure sources 96,98 are connected by conduits 100,102, respectively, to a conduit 104 by a three-way valve 106. The conduit 104 runs to the cap 90 where it leads to the cavity 44. Hence, by suitable manipulation of the valve 106, that part of the cavity 44 above the head 34 may be placed under either sub-atmospheric pressure or super-atmospheric pressure at suitable phases during the operational cycle of the apparatus 10. This pressure is transmitted through the filter 94 to the portion of the cavity 44 below the head 34 where the cavity communicates with the outlet end of the tube 84 leading from the hopper.

Between the discharge nozzle 18 at the bottom of the measuring chamber and the discharge end of the powder inlet tube 84, a discharge valve 36 is provided. This may take any convenient form and in the particular dispensing head constituting a second and preferred embodiment of the invention the discharge valve is a pinch valve in the form of an elastomeric tube 108 constituting a continuation of the lower end of the measuring chamber 30 and contained within a vertical block 109 forming part of the dispensing head 20. The block is supplied with a lateral opening 110 through which passes a pin 112, the tip of which bears against the outer side wall of the tube 108 and is adapted to be moved into and out of bearing engagement with said wall by any suitable means as, for example, a mechanical part such as a cam or lever or an electrically actuated part such as a solenoid or a pneumatically actuated part such as an air cylinder 114, the latter being illustrated. When high pressure air is admitted to the lefthand end of the cylinder, a piston is thrust tubeward to press the tip of the pin 112 against the opposed side of the block and thereby collapse the tube and close the discharge valve 36. Admission of air under pressure to the righthand side of the cylinder will force the tip of the pin away from the opposed wall of the block and permit the tube to spring back to open the discharge valve. The timing of the operation of all of this will be discussed later when discussing the operational cycle of the apparatus 10.

Figure 11:
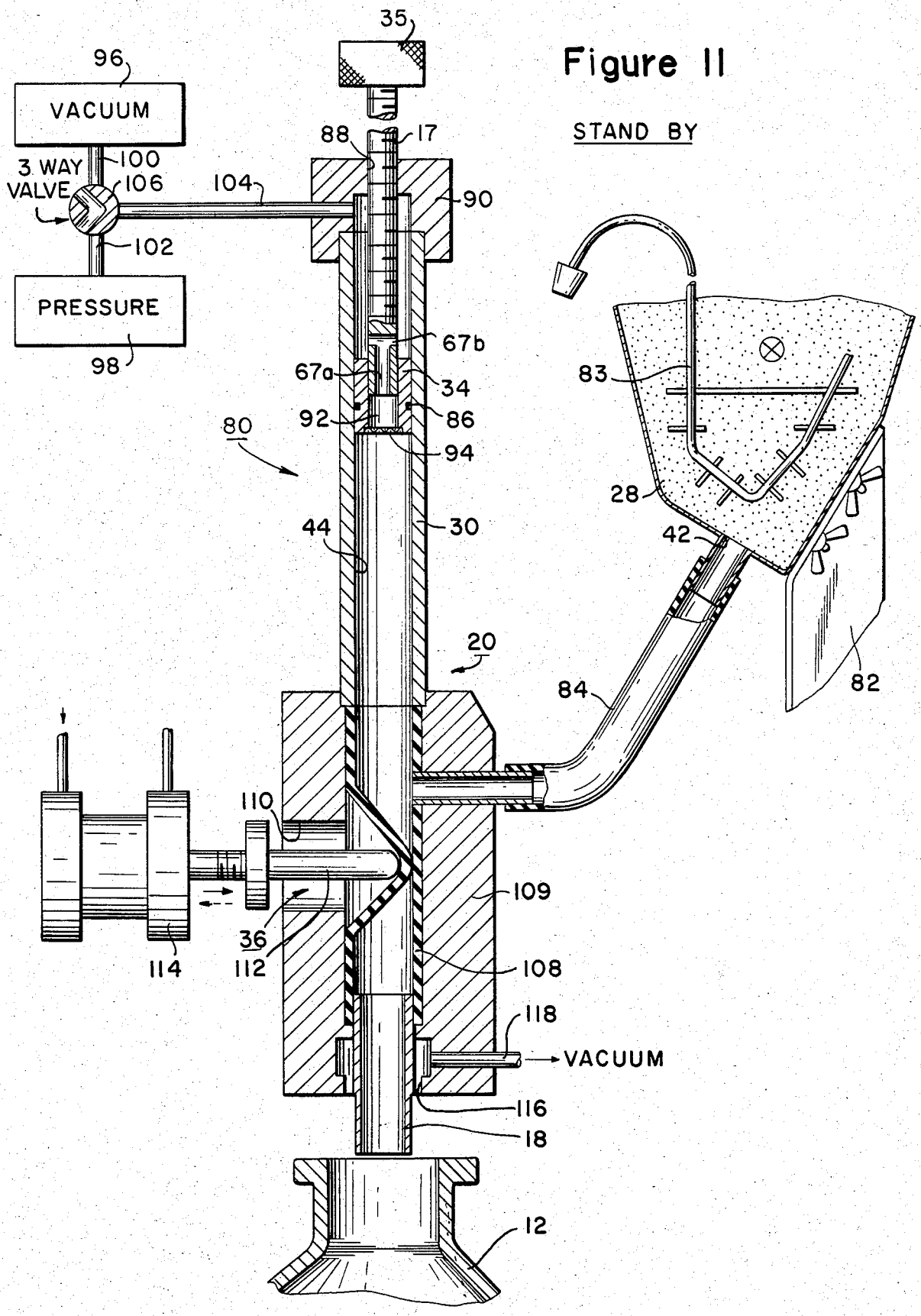
FIG. 11 is a view similar to FIG. 3 of a machine embodying a preferred form of the invention which is designed to handle only powder, the portion of the machine there shown being the dispensing head, the dispensing head being illustrated in its stand-by condition.

Turning now to the performance of the apparatus, FIG. 11 illustrates the positions of the parts and the flow of gases during the standby portion of the cycle. At this time, the discharge valve 36 is closed. The conduit 104 is connected neither to a source of air at sub-atmospheric pressure, nor to a source of gases at super-atmospheric pressure. The agitator 82 is reciprocating in the direction of the indicated arrow perpendicular to the plane of the drawing to prevent bridging of powder in the hopper or to eliminate any bridging that has occurred. At this time, there will be some flow of powdered material out of the discharge outlet 42 and out of the tube 84. Some of the powder may reach the cavity 44, but the amount is inconsequential. At this moment, a container may be located below the discharge nozzle and the discharge nozzle may be in coupling relationship therewith. The exact moment at which this placement of the container occurs and the coupling is not important so long as it occurs prior to the commencement of dosing.

Figure 12:
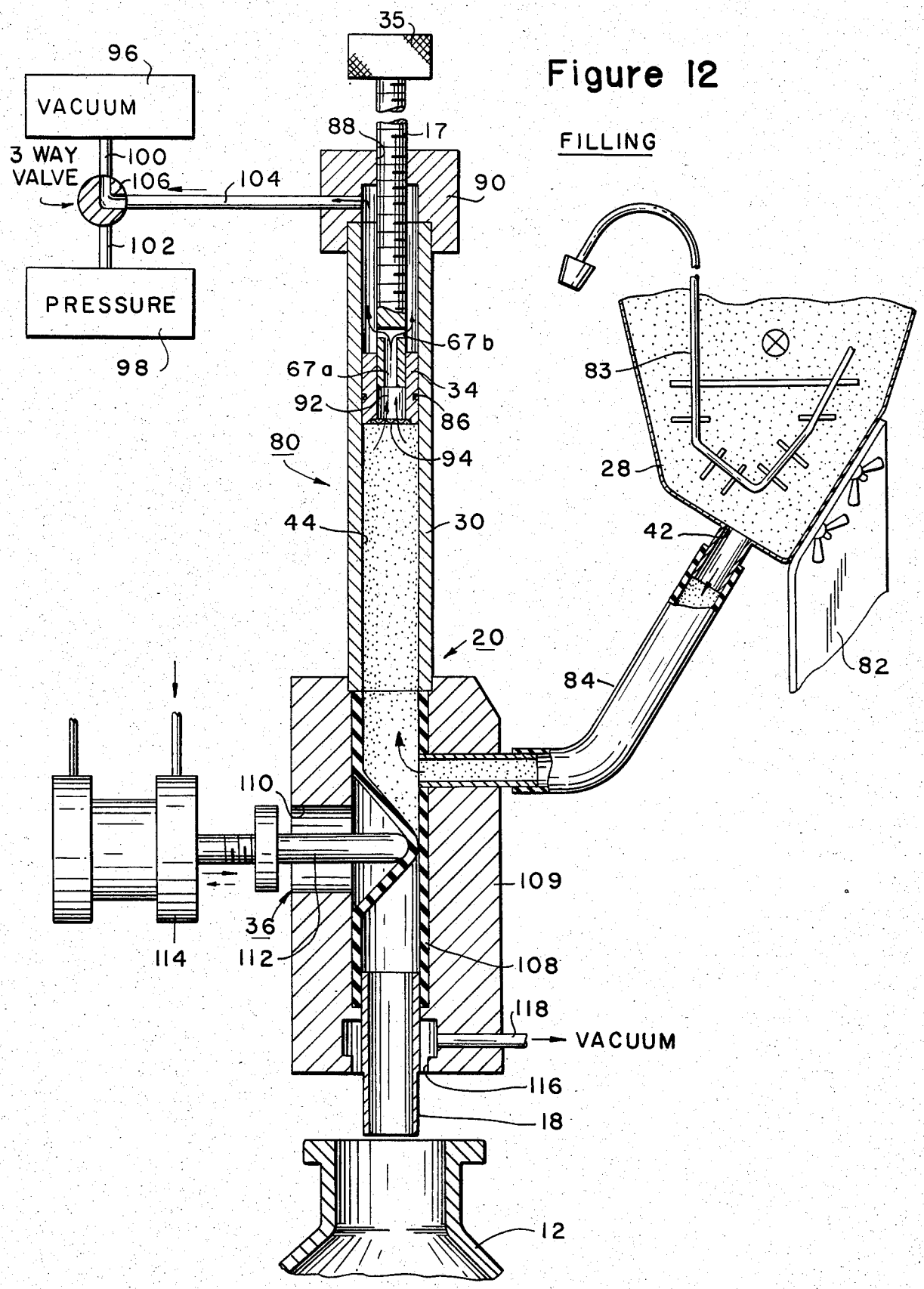
FIG. 12 is a view similar to FIG. 11 showing the parts of the dispensing head in their filling positions.

The next thing that occurs is the filling step of the cycle whereat the three-way valve 106 is turned to the position illustrated in FIG. 12 in which the conduit 100 connects the source of air at sub-atmospheric pressure to the conduit 104 and through that conduit to the upper portion of the cavity 44 above the head 34, the vacuum pressure being transmitted through the central passageway 67*a* and cross passageways 67*b* and through the well 92 and the filter 94 to the lower portion of the cavity 44 below the head 34, such vacuum reaching all the way to the lateral inlet from the discharge tube 84 from the hopper. The moment this event takes place, there is a sudden spurt-like activity of powder from the tube 84 into the cavity 44 up into the cavity and up to the head 34. The powder, in effect, is projected in an almost solid stream to violently fill the cavity 44 beneath the filter 92 which the powder cannot pass, the powder filling the cavity 44 all the way down to the closed discharge valve 36 and blocking the entrance to the tube 84 into the measuring chamber 30. This event transpires with extreme rapidity. The description thereof takes far longer to read than to perform. Moreover, the filling takes place rapidly and with such force that the powder packs uniformly and with great regularity, that is to say, the packing does not vary from cycle to cycle so that the "fill" of the measuring chamber can be relied upon to be accurate. The rapidity of the fill portion of the cycle is almost unbelievable. Typically, a 1 to 10 cc chamber is filled in under a tenth of a second and, moreover, the fill takes place in a completely closed environment. There is little or no escape of powder into the environment from the hopper. There is no noticeable escape of powder into the environment from the filling chamber or from the cavity above the head.

Figure 13:
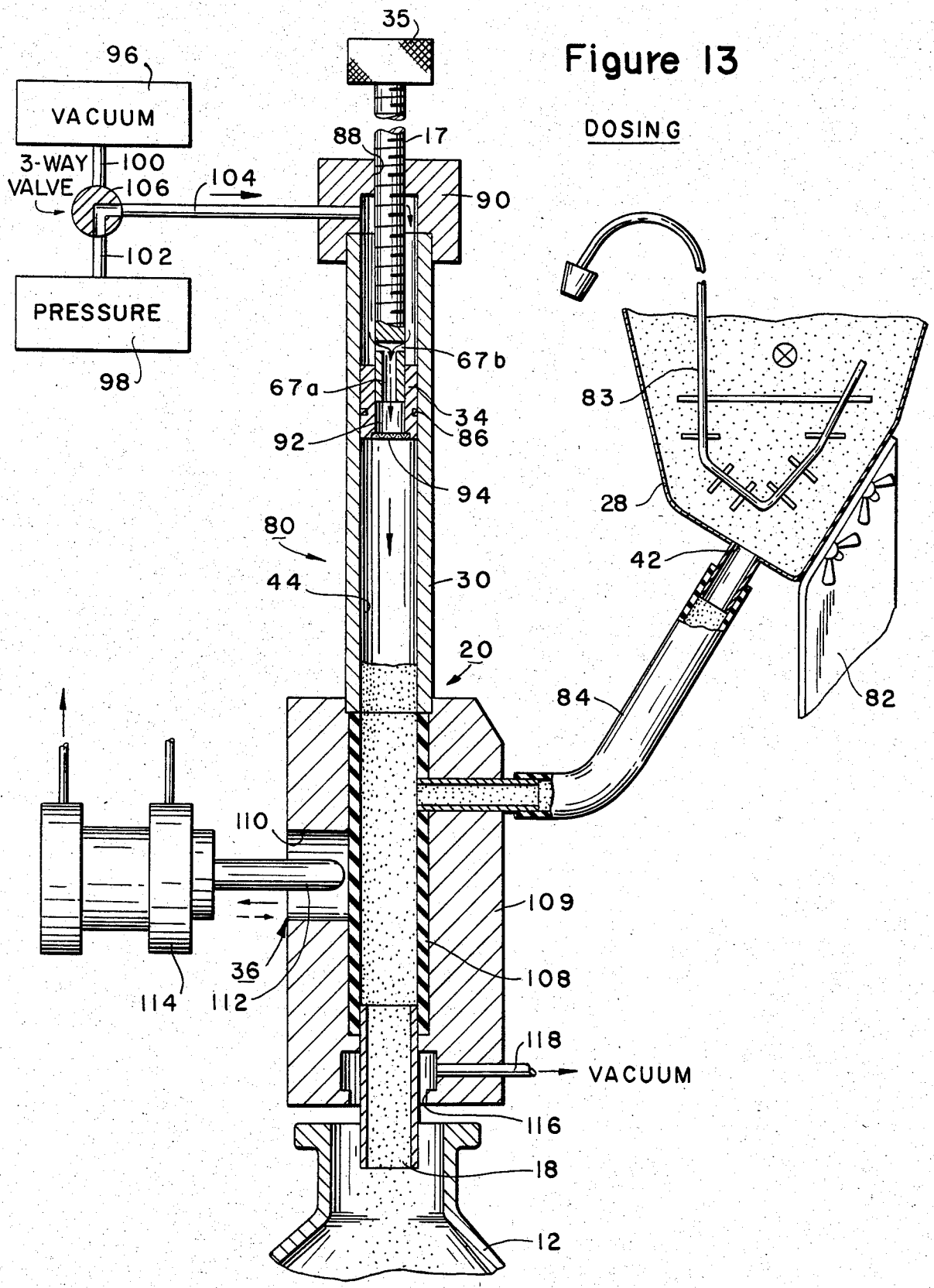
FIG. 13 is a view similar to FIG. 12 showing the parts of the dispensing head in their dosing positions.

The next step in the cycle of operations is the dosing phase, which is every bit as rapid as the filling phase. The dosing phase is illustrated in FIG. 13. For this phase to be performed, the three-way valve 106 is turned to its FIG. 13 position in which the conduit 104 is connected to the conduit 102 that leads to the super-atmospheric source of pressure so that now, suddenly the cavity above the variable positionable head 34 is filled with air under super-atmospheric pressure which makes its presence felt through the cross-passageways, central passageway, well and filter in the space below the head 34. This introduction of high pressure gas creates a sudden shock and, in effect, is like the firing of a projectile, the bullet, in this case, being the powder between the lower surface of the head 34 and the discharge valve 36. The discharge valve 36 is opened concurrently with the turning of high pressure air into the space above the head 34 so that the "gun", i.e. the cavity with the powder bullet in it, is "fired" at the instant that the "head" of the bullet (powder) (the tip of the powder mass at the surface of the discharge valve) is freed by opening of the discharge valve so that now the powder bullet rapidly descends en masse past the discharge valve through the discharge nozzle into the container where it impacts the bottom of the container to fill the container, its volume having been predetermined to give the desired degree of fill to the container.

It will be observed by the careful reader that a comparison of the second embodiment of the invention, namely that of FIGS. 11 through 14, with the first embodiment of the invention, namely that of FIGS. 1 through 6, will show that there is an element present in the first embodiment not present in the second embodiment, this being the valve 32 which is an infeed valve between the exit port of the hopper and the input port of the measuring chamber. No such infeed valve is present in the FIGS. 11 through 14 embodiment of the invention. Such an infeed valve was considered necessary in the FIGS. 1 through 6 embodiment of the invention because the mass of powder in the measuring chamber did not properly block off the input port of the measuring chamber during transfer of the aspirated (suction induced) infeed of the powder into the measuring chamber, that is to say, the transfer of this mass of powder from such measuring chamber through the discharge nozzle into the container. In the second embodiment of the invention just described, however, the mass of powder being transferred effectively blocks off the input port of the measuring chamber during the transfer of the aspirated mass of powder through the discharge nozzle. This appears to be due to a few causes. One is the extreme rapidity with which the powder moves down from the measuring chamber through the discharge nozzle past the input port. Two is the length of the compacted powder bullet as it moves past the input port. Three is a short duration of the application of super-atmospheric pressure from the source of super-atmospheric pressure 98 through the conduits 102 and 104 to the cavity 44. This pressure is applied just long enough to accelerate the compacted chamber with extreme rapidity and then having reached the required speed, the source of super-atmospheric pressure is appropriately cut off, allowing the momentum acquired by the compacted powder chamber to continue its speedy movement on its way to the container past the input port of the measuring chamber so that by the time the super-atmospheric pressure in the cavity above the upper end of the compacted mass of powder has reached the input port of the measuring chamber, the pressure has dissipated to an extent sufficient not to noticeably blow powder back into the hopper and disturb the powder contents of the hopper. All these three circumstances are believed to combine to eliminate the need for providing an infeed valve at the indicated location and, indeed, the apparatus 80 functions excellently for its described purpose without such an infeed valve.

Figure 14:
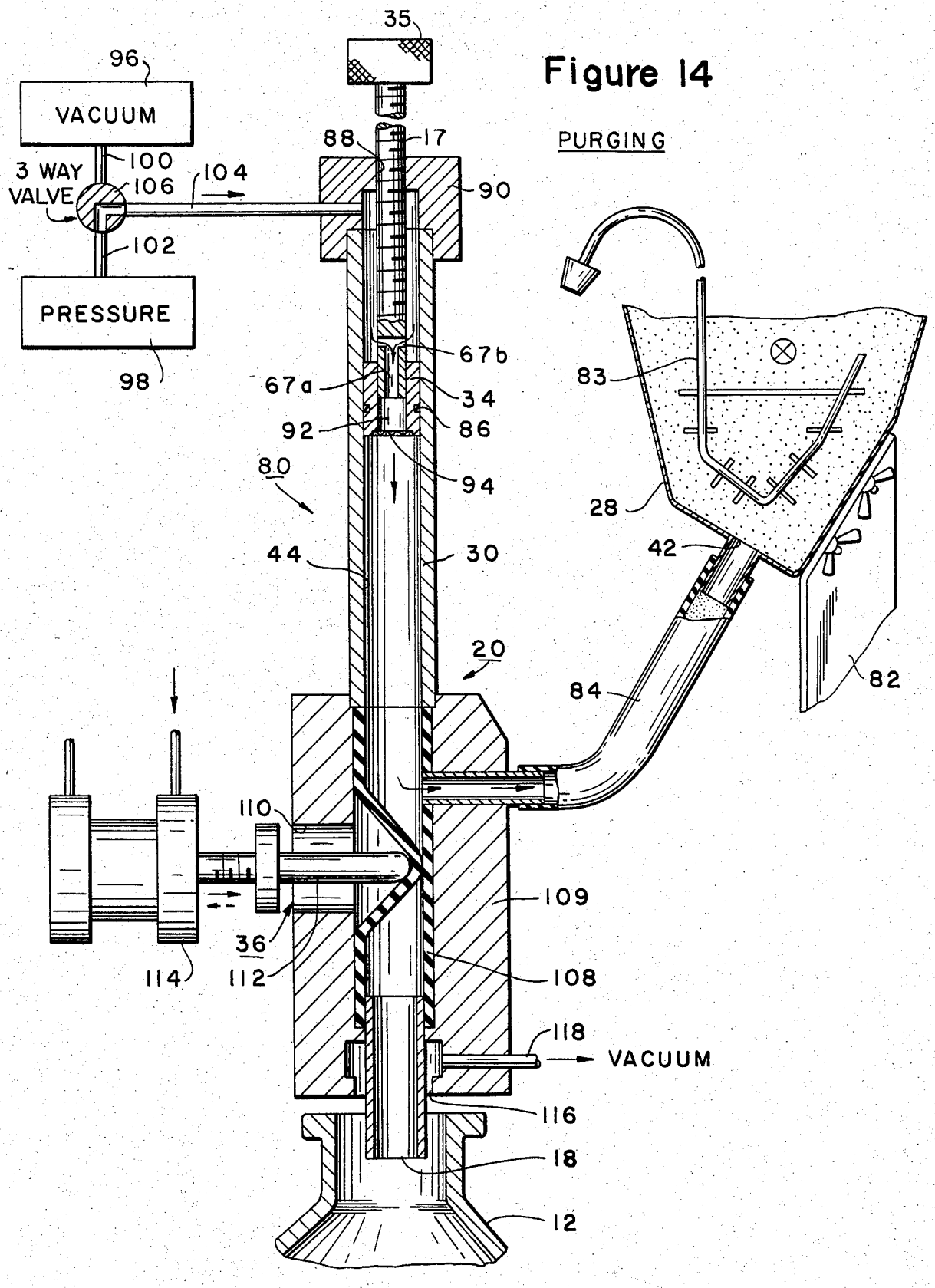
FIG. 14 is a view similar to FIG. 13 showing the parts of the dispensing head in their purging positions.

Proceeding now to the last phase in the operation of apparatus 80, the same constitutes a purge operation for which the position of the parts is illustrated in FIG. 14. At this time, the conduit 104 is connected by the valve 106 to the conduit 102 which, instead of being connected to the high-pressure source 98, which is at approximately 2 psig, now is at 10–20 psig, preferably, of course, a separate high-pressure source is used of either inert gas or air. This high-pressure gas is introduced into the cavity 44 as a sudden very brief pulse in the order of time of one tenth of a second. At the time of its introduction the valve 36 is closed so that the high-pressure gas purges the filter 94, purges the cavity 44 between the head 34 and the opened valve 42, purges the opened valve 42, or at least so much of it as faces the cavity, purges the cavity 44 and purges the inlet port of the measuring chamber, and the inlet tube 84, and stirs up the powder in the lower portion of the hopper.

To minimize discharge of pulverulent material into the room where the dosing is taking place inasmuch as the transfer from the discharge nozzle to the container occurs at atmospheric pressure, suitable shielding means is provided which operates under sub-atmospheric pressure and for this purpose the tip of the discharge nozzle is located in a well 116 in the block 109 where the nozzle emerges from the block so that the major portion of the tip of the nozzle immediately above its front end is surrounded by this well 116 and, moreover, a conduit 118 connected to a suitable source of sub-atmospheric pressure, e.g. the source of vacuum 96, maintains low pressure in the well so that a negative pressure is maintained around the end of the discharge nozzle in the general vicinity of the tip which will tend to draw up any wisps of pulverulent material into the well and out of the room in which dosing is taking place.

Suitable timing arrangements are utilized to control the occurrences of the various events described above. For example, the control may be electronic by means of pulse counting, or mechanical by means of cams or switches, or hydraulic, or pneumatic by means of cams and/or levers.

It will be understood that each of the elements described above, or two or more together, also may find a useful application in other types of constructions differing from the types described above.

While the invention has been illustrated and described as embodied in an apparatus for filling a receptacle with a material, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention and, therefore, such adaptations should and are intended to be comprehended within the meaning and range of equivalence of the following claims.

Thus, it will be seen that there is provided an apparatus and method which carry out the purposes of the present invention and which are well adapted to achieve the objects thereof.

Having thus described the invention there is claimed as new and desired to be secured by Letters Patent:

1. An apparatus for automatically filling receptacles with fluent product substantially free of contaminants, comprising:

(a) a hopper for containing the fluent product;

(b) a measuring chamber having an inlet operatively connected to the hopper, an outlet in alignment with successive receptacles each in their respective turn, and an internal passageway;

(c) a boundary element mounted within, and extending across, the passageway, and operative for resisting passage of the fluent product past the boundary element;

(d) a discharge valve mounted within the passageway and movable between open and closed valve positions in which the discharge valve respectively permits and obstructs communication between the passageway and the outlet, said valve extending across the passageway in the closed valve position remote from the boundary element and bounding therewith an internal cavity;

(e) charging means for suddenly conveying a mass of the fluent product from the hopper through the inlet and into the cavity to charge the cavity when the valve is in the closed valve position, said cavity being substantially closed to the ambient environment exteriorly of the apparatus to resist product contamination during charging of the cavity; and (f) discharging means for suddenly conveying the mass of the fluent product en masse from the cavity through the outlet and into each respectively aligned receptacle to fill each receptacle when the valve is in the open valve position, said cavity being substantially closed to the exterior ambient environment to resist product contamination during filling of each receptacle.

2. The apparatus as recited in claim 1, wherein the measuring chamber is stationarily mounted in an upright orientation on the apparatus above the receptacles.

3. The apparatus as recited in claim 1, wherein the measuring chamber is elongated along a generally vertical axis, and is mounted on the apparatus above the receptacles for axial movement; and further comprising means for axially moving the outlet into an open neck region of each respectively aligned receptacle to position the outlet within the neck region during filling of each receptacle, and for axially moving the outlet out of each open neck region after filling.

4. The apparatus as recited in claim 1, wherein the measuring chamber is non-rotatably mounted on the apparatus.

5. The apparatus as recited in claim 3, wherein the hopper is stationarily mounted on the apparatus adjacent the measuring chamber; and wherein the charging means includes an elongated flexible hose having one end region connected to the stationary hopper, and another end region connected to the movable measuring chamber, said hose spanning the distance between the stationary hopper and the movable measuring chamber and having freedom of movement during the axial movement of the movable measuring chamber.

6. The apparatus as recited in claim 1, wherein the measuring chamber is elongated along an axis and is mounted on the apparatus in an upright orientation; and wherein the boundary element is mounted at an upper end region of the passageway; and wherein the discharge valve is mounted at a lower end region of the passageway; and wherein the inlet of the measuring chamber is laterally disposed between the upper and end regions of the passageway.

7. The apparatus as recited in claim 6, wherein the hopper contains powder, and wherein the boundary element is a porous filter operative for resisting passage of the powder therethrough.

8. The apparatus as recited in claim 7, wherein the charging means includes suction means in communication with the internal passageway through the filter, and operative for abruptly creating a sub-atmospheric pressure within the internal passageway to abruptly draw the powder in one axial direction into the cavity during charging of the cavity.

9. The apparatus as recited in claim 8, wherein the discharging means includes pressurized means in communication with the internal passageway through the filter, and operative for abruptly forcing a carrier gas at supra-atmospheric pressure through the filter into the cavity in an opposite axial direction countercurrent to said one axial direction to abruptly expel the powder en masse and entrained by the carrier gas from the cavity during filling of each receptacle.

10. The apparatus as recited in claim 7; and further comprising means for adjusting the position of the filter within the passageway to control the volumetric capacity of the cavity, said adjusting means including an adjustable element located exteriorly of the measuring chamber and accessible to a user.

11. The apparatus as recited in claim 9, wherein the discharging means is operative after a predetermined time period after operation of the charging means, and wherein said discharge valve remains in the closed valve position and said cavity remains substantially closed to the exterior ambient atmosphere to resist product contamination during said predetermined time period.

12. The apparatus as recited in claim 11, wherein the discharge valve is a pinch valve having a flexible, resilient, tubular sleeve mounted in the passageway, and an actuating member operative for urging a wall portion of the sleeve across the passageway in the closed valve position, said wall portion supporting the mass of powder from below the same during charging of the cavity and during said predetermined time period.

13. The apparatus as recited in claim 7, wherein the inlet of the measuring chamber is in constantly open communication with the hopper.

14. The apparatus as recited in claim 13; and further comprising purge means for suddenly purging the cavity of residue powder within the cavity after operation of the discharging means, said purge means including means in communication with the internal passageway through the filter, and operative, when the discharge valve is in the closed valve position, for abruptly forcing a purge gas at an elevated pressure through the filter into the cavity to abruptly expel residue powder through the constantly-open inlet back into the hopper to resist powder loss during operation of the apparatus.

15. The apparatus as recited in claim 14, wherein the elevated pressure of the purge gas is of a predetermined magnitude and exists for a predetermined time interval sufficient to agitate at least some of the powder in the hopper.

16. The apparatus as recited in claim 7, wherein the charging means and the discharging means each convey the powder mass along a flow path free of abrading parts which would tend to abrade the powder.

17. The apparatus as recited in claim 7; and further comprising dust collection means adjacent the outlet of the measuring chamber for collecting dust and other contaminants in the circumambient region of the outlet, and for conveying such collected dust and other contaminants away from each receptacle.

18. The apparatus as recited in claim 7; and further comprising an agitator mounted within the powder contained in the hopper but out of direct contact with the hopper itself, said agitator being operative for shaking the powder and maintaining the same in a flowable condition.

19. An apparatus for automatically filling receptacles with powder substantially free of contaminants, comprising:

(a) a hopper for containing the powder;

(b) an upright measuring chamber having an inlet in constantly open communication with the hopper, an outlet positioned above successive receptacles each in their respective turn, and an internal elongated passageway;

(c) a porous filter mounted within, and extending across an upper region of, the passageway, and operative for resisting passage of powder through the filter;

(d) a discharge valve mounted within the passageway and movable between open and closed valve positions in which the discharge valve respectively permits and obstructs communication between the passageway and the outlet, said valve extending across a lower region of the passageway in the closed valve position remote from the filter, and bounding with the filter an internal cavity;

(e) charging means for suddenly conveying a mass of the powder from the hopper through the inlet and into the cavity when the valve is in the closed valve position, said cavity being substantially closed to the ambient environment exteriorly of the apparatus to resist powder contamination during charging of the cavity; and (f) discharging means for suddenly conveying the mass of the powder en masse from the cavity through the outlet and into each respectively positioned receptacle to fill each receptacle when the valve is in the open position, said cavity being substantially closed to the exterior ambient environment to resist powder contamination during filling of each receptacle.

20. A method of automatically filling receptacles with powder substantially free of contaminants, comprising the steps of:

(a) containing the powder in a hopper;

(b) constantly openly communicating an inlet of an upright measuring chamber with the hopper;

(c) positioning an outlet of the chamber above successive receptacles each in their respective turn;

(d) mounting a porous filter within, and extending across, an upper region of an internal elongated passageway provided in the chamber, said filter being operative for resisting passage of powder therethrough;

(e) mounting a discharge valve within a lower region of the passageway;

(f) moving the valve between open and closed positions in which the valve respectively permits and obstructs communication between the passageway and the outlet, said valve in the closed valve position extending across the lower region remote from the filter and bounding therewith an internal cavity;

(g) suddently conveying a mass of the powder from the hopper through the inlet and into the cavity when the valve is in the closed valve position, said cavity being substantially closed to the ambient environment exteriorly of the apparatus to resist powder contamination during charging of the cavity; and (h) suddenly conveying the mass of the powder en masse from the cavity through the outlet and into each respectively positioned receptacle to fill each receptacle when the valve is in the open position, said cavity being substantially closed to the exterior ambient environment to resist powder contamination during filling of each receptacle.

* * * * *